US007047188B2

(12) United States Patent
Jasiuk et al.

(10) Patent No.: US 7,047,188 B2
(45) Date of Patent: May 16, 2006

(54) METHOD AND APPARATUS FOR IMPROVEMENT CODING OF THE SUBFRAME GAIN IN A SPEECH CODING SYSTEM

(75) Inventors: Mark A. Jasiuk, Chicago, IL (US); James P. Ashley, Naperville, IL (US); Udar Mittal, Hoffman Estates, IL (US)

(73) Assignee: Motorola, Inc., Schaumburg, IL (US)

( * ) Notice: Subject to any disclaimer, the term of this patent is extended or adjusted under 35 U.S.C. 154(b) by 562 days.

(21) Appl. No.: 10/290,572

(22) Filed: Nov. 8, 2002

(65) Prior Publication Data

US 2004/0093205 A1 May 13, 2004

(51) Int. Cl.
*G10L 19/04* (2006.01)

(52) U.S. Cl. ..... 704/220; 704/223

(58) Field of Classification Search ..... 704/220–223
See application file for complete search history.

(56) References Cited

U.S. PATENT DOCUMENTS 5,233,660 A * 8/1993 Chen ..... 704/208
5,327,521 A 7/1994 Savic et al.
5,359,696 A * 10/1994 Gerson et al. ..... 704/223
5,469,527 A * 11/1995 Drogo de Iacovo et al. ..... 704/220
5,675,702 A * 10/1997 Gerson et al. ..... 704/223
5,687,284 A * 11/1997 Serizawa et al. ..... 704/222
5,751,901 A * 5/1998 DeJaco et al. ..... 704/216
5,809,459 A 9/1998 Bergstrom et al.
5,890,108 A 3/1999 Yeldener
5,899,968 A * 5/1999 Navarro et al. ..... 704/220
6,073,092 A * 6/2000 Kwon ..... 704/219
6,141,638 A * 10/2000 Peng et al. ..... 704/211
6,311,154 B1 10/2001 Gersho et al.

OTHER PUBLICATIONS

Xydeas, C.S.; Papanastasiou, C.;"Split matrix quantization of LPC parameters" Speech and Audio Processing, IEEE Transactions on vol. 7, issue 2, Mar. 1999 pp.: 113-125.*

* cited by examiner

*Primary Examiner*—Richemond Dorvil
*Assistant Examiner*—Michael N. Opsasnick
(74) *Attorney, Agent, or Firm*—Steven A. May

(57) ABSTRACT

A speech coder that performs analysis-by-synthesis coding of a signal determines gain parameters for each constituent component of multiple constituent components of a synthetic excitation signal. The speech coder generates a target vector based on an input signal. The speech coder further generates multiple constituent components associated with the synthetic excitation signal, wherein one constituent component of the multiple constituent components is based on a shifted version of another constituent component of the multiple constituent components. The speech coder further evaluates an error criteria based on the target vector and the multiple constituent components to determine a gain associated with each constituent component of the multiple constituent components.

28 Claims, 6 Drawing Sheets

100
—PRIOR ART—

—PRIOR ART—

METHOD AND APPARATUS FOR IMPROVEMENT CODING OF THE SUBFRAME GAIN IN A SPEECH CODING SYSTEM

CROSS-REFERENCE TO RELATED APPLICATION

This application is related to U.S. patent application Ser. No. 10/291,056, filed on the same date as this application.

FIELD OF THE INVENTION

The present invention relates, in general, to signal compression systems and, more particularly, to Code Excited Linear Prediction (CELP)-type speech coding systems.

BACKGROUND OF THE INVENTION

Low rate coding applications, such as digital speech, typically employ techniques, such as a Linear Predictive Coding (LPC), to model the spectra of short-term speech signals. Coding systems employing an LPC technique provide prediction residual signals for corrections to characteristics of a short-term model. One such coding system is a speech coding system known as Code Excited Linear Prediction (CELP) that produces high quality synthesized speech at low bit rates, that is, at bit rates of 4.8 to 9.6 kilobits-per-second (kbps). This class of speech coding, also known as vector-excited linear prediction or stochastic coding, is used in numerous speech communications and speech synthesis applications. CELP is also particularly applicable to digital speech encryption and digital radiotelephone communication systems wherein speech quality, data rate, size, and cost are significant issues.

A CELP speech coder that implements an LPC coding technique typically employs long-term ("pitch") and short-term ("formant") predictors that model the characteristics of an input speech signal and that are incorporated in a set of time-varying linear filters. An excitation signal, or codevector, for the filters is chosen from a codebook of stored codevectors. For each frame of speech, the speech coder applies the codevector to the filters to generate a reconstructed speech signal, and compares the original input speech signal to the reconstructed signal to create an error signal. The error signal is then weighted by passing the error signal through a weighting filter having a response based on human auditory perception. An optimum excitation signal is then determined by selecting one or more codevectors that produce a weighted error signal with a minimum energy for the current frame.

For example, FIG. 1 is a block diagram of a CELP coder 100 of the prior art. In CELP coder 100, an input signal s(n) is applied to a linear predictive (LP) analyzer 101, where linear predictive coding is used to estimate a short-term spectral envelope. The resulting spectral coefficients (or linear prediction (LP) coefficients) are denoted by the transfer function A(z). The spectral coefficients are applied to an LP quantizer 102 that quantizes the spectral coefficients to produce quantized spectral coefficients $A_q$ that are suitable for use in a multiplexer 109. The quantized spectral coefficients $A_q$ are then conveyed to multiplexer 109, and the multiplexer produces a coded bitstream based on the quantized spectral coefficients and a set of excitation vector-related parameters L, β, I, and γ, that are determined by a squared error minimization/parameter quantization block 108. As a result, for each block of speech, a corresponding set of excitation vector-related parameters is produced that includes long-term predictor (LTP) parameters L and β, and fixed codebook index I and scale factor γ.

The quantized spectral parameters are also conveyed locally to an LP synthesis filter 105 that has a corresponding transfer function $1/A_q(z)$. LP synthesis filter 105 also receives a combined excitation signal ex(n) and produces an estimate of the input signal ŝ(n) based on the quantized spectral coefficients $A_q$ and the combined excitation signal ex(n). Combined excitation signal ex(n) is produced as follows. A fixed codebook (FCB) codevector, or excitation vector, $\tilde{c}_1$ is selected from a fixed codebook (FCB) 103 based on an fixed codebook index parameter I. The FCB codevector $\tilde{c}_1$ is then weighted based on the gain parameter γ and the weighted fixed codebook codevector is conveyed to a long-term predictor (LTP) filter 104. LTP filter 104 has a corresponding transfer function '$1/(1-\beta z^{-L})$,' wherein β and L are excitation vector-related parameters that are conveyed to the filter by squared error minimization/parameter quantization block 108. LTP filter 104 filters the weighted fixed codebook codevector received from FCB 103 to produce the combined excitation signal ex(n) and conveys the excitation signal to LP synthesis filter 105.

LP synthesis filter 105 conveys the input signal estimate ŝ(n) to a combiner 106. Combiner 106 also receives input signal s(n) and subtracts the estimate of the input signal ŝ(n) from the input signal s(n). The difference between input signal s(n) and input signal estimate ŝ(n) is applied to a perceptual error weighting filter 107, which filter produces a perceptually weighted error signal e(n) based on the difference between ŝ(n) and s(n) and a weighting function W(z). Perceptually weighted error signal e(n) is then conveyed to squared error minimization/parameter quantization block 108. Squared error minimization/parameter quantization block 108 uses the error signal e(n) to determine an optimal set of excitation vector-related parameters L, β, I, and γ that produce the best estimate ŝ(n) of the input signal s(n). The quantized LP coefficients and the optimal set of parameters L, β, I, and γ are then conveyed over a communication channel to a receiving communication device, where a speech synthesizer uses the LP coefficients and excitation vector-related parameters to reconstruct the input speech signal s(n).

In a CELP coder such as coder 100, a synthesis function for generating the CELP coder combined excitation signal ex(n) is given by the following generalized difference equation:

$$ex(n)=\gamma\tilde{c}_1(n)+\beta ex(n-L),\ n=0,\ N-1 \tag{1}$$

where ex(n) is a synthetic combined excitation signal for a subframe, $\tilde{c}_1(n)$ is a codevector, or excitation vector, selected from a codebook, such as FCB 103, I is an index parameter, or codeword, specifying the selected codevector, γ is the gain for scaling the codevector, ex(n−L) is a synthetic combined excitation signal delayed by L samples relative to the n-th sample of the current subframe for voiced speech L is typically related to the pitch period), β is a long term predictor (LTP) gain factor, and N is the number of samples in the subframe. When n−L<0, ex(n−L) contains the history of past synthetic excitation, constructed as shown in equation (1). That is, for n−L<0, the expression 'ex(n−L)' corresponds to an excitation sample constructed prior to the current subframe, which excitation sample has been delayed and scaled pursuant to an LTP filter transfer function '$1/(1-\beta z^{-L})$.'

The task of a typical CELP speech coder such as coder 100 is to select the parameters specifying the synthetic excitation, that is, the parameters L, β, I, γ in coder 100, given ex(n) for n<0 and the determined coefficients of short-term Linear Predictor (LP) filter 105, so that when the synthetic excitation sequence ex(n) for n=0, N−1 is filtered through LP filter 105 to yield the synthesized speech signal ŝ(n), the synthesized speech signal most closely approximates, according to a distortion criterion employed, the input speech signal s(n) to be coded at a subframe.

For values of L greater than or equal to N, that is, L≧N, equation (1) is implemented exactly. In such a case, synthetic excitation for the subframe can be equivalently defined as $$ex(n)=\beta c_o(n)+\gamma c_1(n),\ n=0,\ N-1, \tag{2}$$

where $$c_0(n)=ex(n-L),\ n=0,\ N-1, \tag{3}$$

$$c_1(n)=\tilde{c}_1(n),\ n=0,\ N-1, \tag{4}$$

and where $c_0(n)$ is an LTP vector selected for the subframe and $c_1(n)$ is a selected codevector for the subframe. Since L≧N, $c_0(n)$ and $c_1(n)$, once chosen, are explicitly independent of β and γ in the formulation of equation (2). Moreover, $c_0(n)$ is only a function of ex(n) for n<0, which keeps the solution for β a linear problem. Likewise, because L≧N, $c_1(n)$ is not affected by long term predictor (LTP) filter 104 at the current subframe. These facts simplify a selection of parameters (L, β, I, γ) by the squared error minimization/parameter quantization block 108 of speech coder 100. A range of L is chosen to cover an expected range of pitch over a wide variety of speakers, and at 8 kHz sampling frequency the range's lower bound is typically set to around 20 samples, corresponding to a pitch frequency of 400 Hz. In order to achieve good coding efficiency, it is advantageous to use $N>L_{min}$, where $L_{min}$ is the lower bound on the delay range. Typically the coder's excitation parameters are transmitted at a subframe rate, which subframe rate is inversely proportional to subframe length N. That is, the longer the subframe length N, the less frequently it is necessary to quantize and transmit the coder's subframe parameters.

For values of L less than N, that is, L<N, equation (2) ceases to be equivalent to equation (1). In order to retain the advantages of using the form of equation (2) when L<N, one idea, proposed in U.S. Pat. No. 4,910,781, entitled "Code Excited Linear Predictive Vocoder Using Virtual Searching," is to modify the definition of $c_0(n)$ as follows:

$$ex(n) = \beta c_o(n) + \gamma c_1(n),\ n = 0,\ N-1, \tag{5}$$

where $$c_0(n) = \begin{cases} ex(n-L),\ n = 0,\ \mathrm{Min}(L, N) - 1, \\ c_0(n-L),\ n = L,\ N-1 \end{cases} \tag{6}$$

$$c_1(n) = \tilde{c}_l(n),\ n = 0,\ N-1 \tag{7}$$

In equation (6), $c_0(n)$ contains a vector fetched from a "virtual codebook," typically an adaptive codebook (ACB), where L<N is allowed. The definition of $c_1(n)$ as given in equation (4) is retained in equation (6), which means that, when L<N, $\tilde{c}_1(n)$ is exempted from being filtered by an LTP filter. This is another departure from direct implementation of equation (1). Thus, equation (5) has the advantages of providing the simplified implementation provided by equation (2) while also permitting L<N. It does so by departing from an exact implementation of equation (1) when L<N.

For example, FIG. 2 is a block diagram of another CELP coder 200 of the prior art that implements equations (5)–(7). Similar to CELP coder 100, in CELP coder 200, quantized spectral coefficients $A_q$ are produced by an LP Analyzer 101 and an LP quantizer 102, which quantized spectral coefficients are conveyed to a multiplexer 109 that produces a coded bitstream based on the quantized spectral coefficients and a set of excitation vector-related parameters L, β, I, and γ, that are determined by a squared error minimization/parameter quantization block 108. The quantized spectral coefficients $A_q$ are also conveyed locally to an LP synthesis filter 105 that has a corresponding transfer function $1/A_q(z)$. LP synthesis filter 105 also receives a combined excitation signal ex(n) and produces an estimate of the input signal ŝ(n) based on the quantized spectral coefficients $A_q$ and the combined excitation signal ex(n).

CELP coder 200 differs from CELP coder 100 in the techniques used to produce combined excitation signal ex(n). In CELP coder 200, a first excitation vector $c_0(n)$ is selected from a virtual codebook 201 based on the excitation vector-related parameter L. Virtual codebook 201 typically is an adaptive codebook (ACB), in which event the first excitation vector is an adaptive codebook (ACB) codevector. The virtual codebook codevector $c_0(n)$ is then weighted based on the gain parameter β and the weighted virtual codebook codevector is conveyed to a first combiner 203. A fixed codebook (FCB) codevector, or excitation vector, $\tilde{c}_1(n)$ is selected from a fixed codebook (FCB) 202 based on the excitation vector-related parameter I FCB codevector $\tilde{c}_1(n)$ (or equivalently $c_1(n)$, per equation (7)) is then weighted based on the gain parameter γ and is also conveyed to first combiner 203. First combiner 203 then produces the combined excitation signal ex(n) by combining the weighted version of virtual codebook codevector $c_0(n)$ with the weighted version of FCB codevector $c_1(n)$.

LP synthesis filter 105 conveys the input signal estimate ŝ(n) to a second combiner 106. Second combiner 106 also receives input signal s(n) and subtracts the input signal estimate ŝ(n) from the input signal s(n). The difference between input signal s(n) and input signal estimate ŝ(n) is applied to a perceptual error weighting filter 107, which filter produces a perceptually weighted error signal e(n) based on the difference between ŝ(n) and s(n) and a weighting function W(z). Perceptually weighted error signal e(n) is then conveyed to a squared error minimization/parameter quantization block 108. Squared error minimization/parameter quantization block 108 uses the error signal e(n) to determine an optimal set of excitation vector-related parameters L, β, I, and γ that produce the best estimate ŝ(n) of the input signal s(n). Similar to coder 100, coder 200 conveys the quantized spectral coefficients and the selected set of parameters L, β, I, and γ over a communication channel to a receiving communication device, where a speech synthesizer uses the LP coefficients and excitation vector-related parameters to reconstruct the coded version of input speech signal s(n).

In a paper entitled "Design of a psi-celp coder for mobile communications," by Mano, K; Moriya, T; Miki, S; and Ohmuro, H., Proceedings of the IEEE Workshop on Speech Coding for Telecommunications, pp. 21–22, Oct. 13–15, 1993, the "virtual codebook" concept proposed in U.S. Pat.

No. 4,910,781 was extended to also modify the definition of the a fixed codebook codevector when L<N, that is, $$ex(n) = \beta c_o(n) + \gamma c_1(n),\ n = 0, N-1, \tag{8}$$

where $$c_0(n) = \begin{cases} ex(n-L),\ n = 0, \mathrm{Min}(L, N)-1, \\ c_0(n-L),\ n = L, N-1 \end{cases} \tag{9}$$

$$c_1(n) = \begin{cases} \tilde{c}_l(n),\ n = 0, \mathrm{Min}(L, N)-1, \\ c_l(n-L),\ n = L, N-1 \end{cases} \tag{10}$$

It is apparent in equations (8), (9), and (10) that when L<N, $c_1(n)$ is periodic in L over N samples.

Another technique for approximating equation (1) when L<N is proposed in the paper "A toll quality 8 kb/s speech codec for the personal communications system (PCS)," by Salami, R., Laflamme, C., Adoul, J.-P., Massaloux, D., and published in IEEE Transactions on Vehicular Technology, Volume 43, Issue 3, Parts 1–2, August 1994, pages 808–816 (hereinafter referred to as "Salami et al."). The idea proposed by Salami et al. is to apply a zero state long-term filter (a "pitch sharpening filter") to generate the excitation codevector $c_1(n)$, where $$ex(n) = \beta c_o(n) + \gamma c_1(n),\ n = 0, N-1 \tag{11}$$

$$c_0(n) = \begin{cases} ex(n-L),\ n = 0, \mathrm{Min}(L, N)-1, \\ c_0(n-L),\ n = L, N-1 \end{cases} \tag{12}$$

$$c_1(n) = \begin{cases} \tilde{c}_l(n),\ n = 0, \mathrm{Min}(\hat{L}, N)-1, \\ \tilde{c}_l(n) + \hat{\beta} c_1(n-\hat{L}),\ n = \hat{L}, N-1 \end{cases} \tag{13}$$

Note that in equation (12) a "virtual codebook," or ACB, is being used and the long-term delay $\hat{L}$, for the "pitch sharpening filter", and L, the delay associated with the ACB, are allowed to be different. For example, L may have a value represented with a fraction of a sample resolution (in which case an interpolating filter would be used to calculate fractionally delayed samples), while $\hat{L}$ may be a function of L, where it is set equal to a value of L rounded or truncated to an integer value closest to L. Alternatively, $\hat{L}$ may be set equal to L. In addition, in Salami et al. $\hat{\beta}$ is a constant set to 0.8.

The presetting of $\hat{\beta}$ to a constant value is a limiting feature of Salami et al. In order to provide an improved approximation of equation (1) when L<N, U.S. Pat. No. 5,664,055, entitled "CS-ACELP Speech Compression System with Adaptive Pitch Prediction Filter Gain Based on a Measure of Periodicity" (hereinafter referred to as the "'055 patent"), proposed making $\hat{\beta}$ a time varying function based on periodicity, for example where $\hat{\beta}$ could be updated at a subframe rate. When β and γ are selected and quantized sequentially, the '055 patent proposed defining $\hat{\beta}$ as $$\hat{\beta} = \mathrm{Max}(0.2, \mathrm{Min}(0.8, \beta)). \tag{14}$$

That is, $\hat{\beta}$ is initially set equal to β, but is then limited to be not less than 0.2 and no greater than 0.8. The approach set out in the '055 patent is the approach used in speech coder standards Telecommunications Industry Association/Electronic Industries Alliance Interim Standard 127 (TIA/EIA/IS-127) and Global System for Mobile communications (GSM) standard 06.60, which standards are hereby incorporated by reference herein in their entirety.

Typically, the determination of optimal gain parameters β and γ is performed in a sequential manner. However, the sequential determination of optimal gain parameters β and γ is actually sub-optimal, because, once β is selected, its value remains fixed when optimization of γ is performed. If β and γ are not selected and quantized sequentially but instead are jointly selected and quantized, that is, are vector quantized as a (β,γ) pair, a problem arises because gain vector quantization is done after $c_0(n)$ and $c_1(n)$ have been selected, but $c_1(n)$ (equation (13)) is a function of $\hat{\beta}$. As defined by equation (14), $\hat{\beta}$ is dependent on the quantized value of β, which is not available until after the vector quantization of the gains β and γ is completed, and the quantized (β,γ) gain vector thus identified. To circumvent this problem, the '055 patent proposes using a modified definition for $\hat{\beta}$ when vector quantization of the gains is employed, that is, $$\hat{\beta} = \mathrm{Max}(0.2, \mathrm{Min}(0.8, \beta_{previous})). \tag{15}$$

$\beta_{previous}$ in equation (15) represents value of β used to define the excitation sequence ex(n) at the preceding subframe. Speech coders described in International Telecommunication Union (ITU) Recommendation G.729, "Coding of Speech at 8 kbit/s using Conjugate-Structure Algebraic-Code-Excited Linear Prediction (CS-ACELP)," Geneva, 1996 and TIA/EIA/IS-641 employ this approach. While this approach solves the non-causality problem outlined, it is less than optimal because $\beta_{previous}$ will not always accurately model β at the current subframe, particularly when the degree of voicing at the current subframe is substantially different from the degree of voicing at the previous subframe, such as in a voiced-to-unvoiced or unvoiced-to-voiced transition region.

Therefore, a need exists for an improved method of quantizing the gain parameters in a CELP-type speech coder, wherein the gain parameters are jointly optimized based on the current subframe.

DETAILED DESCRIPTION OF THE INVENTION

Figure 1:
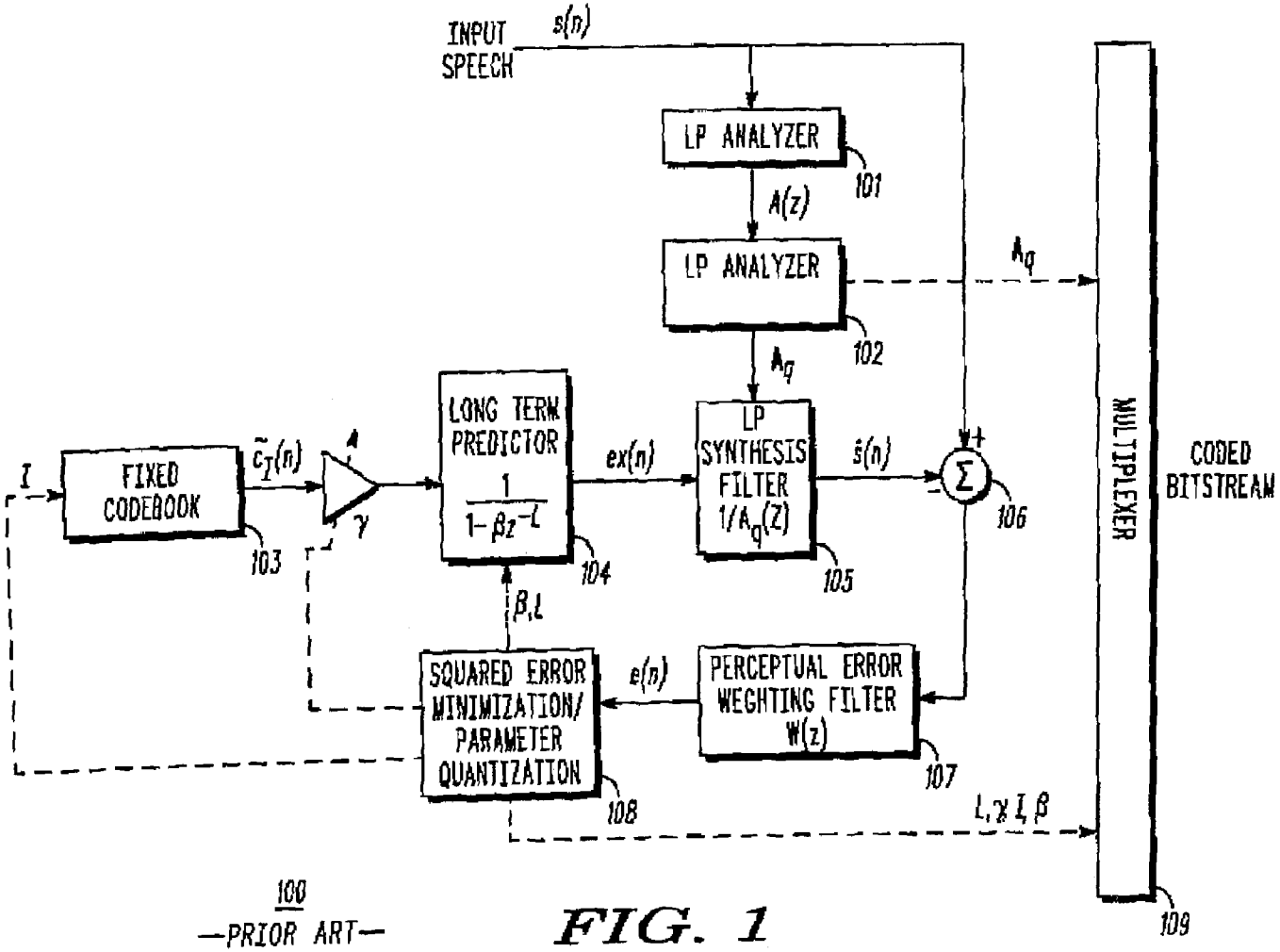
FIG. 1 is a block diagram of a Code Excited Linear Prediction (CELP) coder of the prior art.
Figure 2:
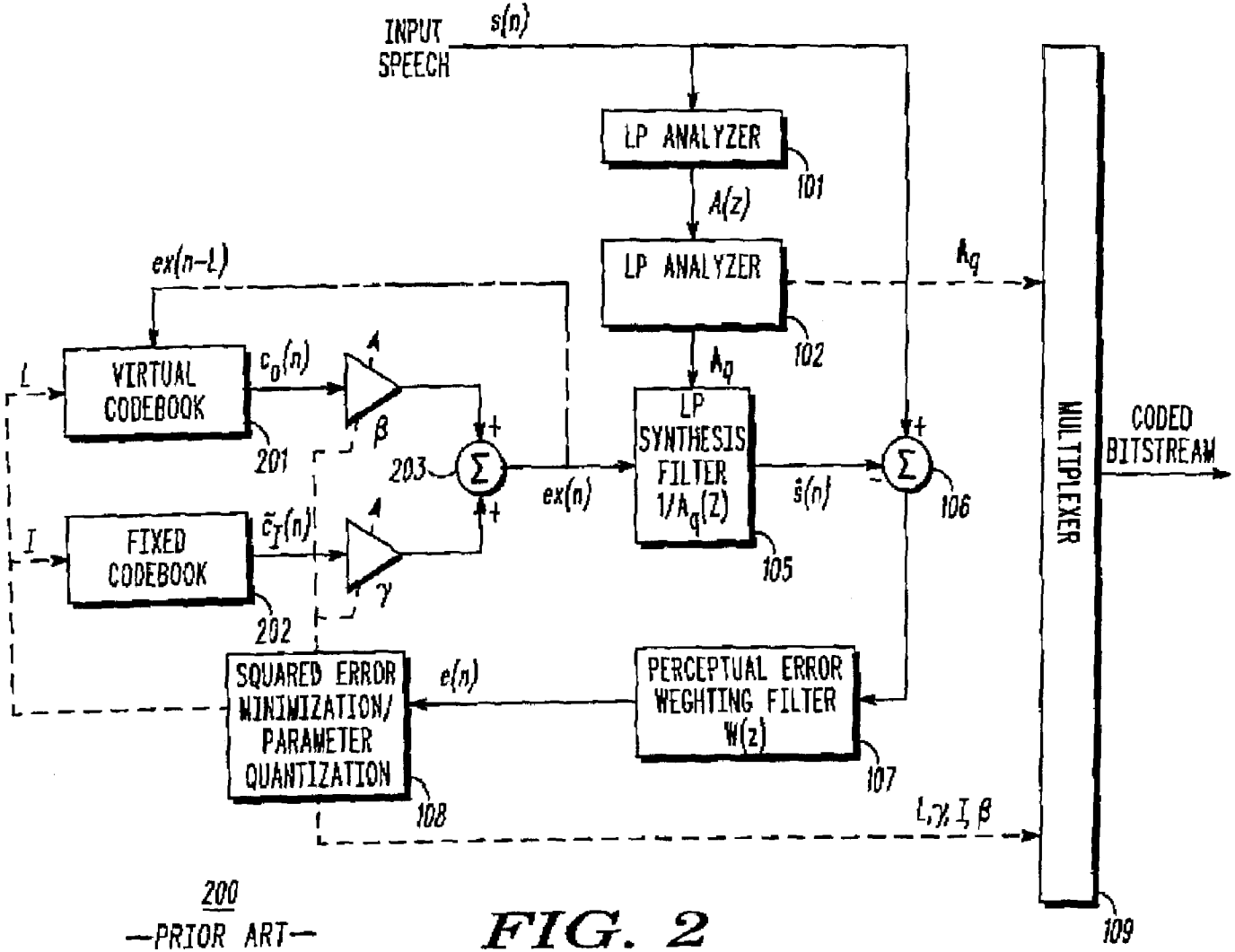
FIG. 2 is a block diagram of another Code Excited Linear Prediction (CELP) coder of the prior art.

To address the need for an improved method of quantizing the gain parameters in a CELP-type speech coder, wherein the gain parameters are jointly optimized based on the current subframe, a speech coder that performs analysis-by-synthesis coding of a signal determines gain parameters for each constituent component of multiple constituent components of a synthetic excitation signal. The speech coder generates a target vector based on an input signal. The speech coder further generates multiple constituent components associated with the synthetic excitation signal, wherein one constituent component of the multiple constituent components is based on a shifted version of another constituent component of the multiple constituent components. The speech coder further evaluates an error criteria based on the target vector and the multiple constituent components to determine a gain associated with each constituent component of the multiple constituent components.

Generally, one embodiment of the present invention encompasses a method for analysis-by-synthesis coding of a signal. The method includes steps of generating a target vector based on an input signal and generating multiple constituent components associated with an synthetic excitation signal, wherein one constituent component of the multiple constituent components is based on a shifted version of another constituent component of the multiple constituent components. The method further includes a step of evaluating an error criteria based on the target vector and the multiple constituent components to determine a gain associated with each constituent component of the multiple constituent components.

Another embodiment of the present invention encompasses an apparatus for analysis-by-synthesis coding of a signal. The apparatus includes a means for generating a target vector based on an input signal and a component generator that generates multiple constituent components associated with an synthetic excitation signal, wherein one constituent component of the multiple constituent components is based on a shifted version of another constituent component of the multiple constituent components. The apparatus further includes an error minimization unit that evaluates an error criteria based on the target vector and the multiple constituent components to determine a gain associated with each constituent component of the multiple constituent components.

Yet another embodiment of the present invention encompasses a method for analysis-by-synthesis coding of a subframe. The method includes steps of generating a target vector based on an input signal, generating multiple constituent components associated with a synthetic excitation signal, and determining an error signal based on the target vector and the multiple constituent components. The method further includes a step of jointly determining multiple gain parameters for the subframe based on the error signal, wherein each gain parameter of the multiple gain parameters is associated with a different codebook of multiple codebooks and wherein the jointly determined multiple gain parameters are not determined based on a gain parameter of an earlier subframe.

Still another embodiment of the present invention encompasses an encoder that performs analysis-by-synthesis coding of a signal. The encoder includes a processor that generates a target vector based on an input signal, generates multiple constituent components associated with an synthetic excitation signal, wherein one constituent component of the multiple constituent components is based on a shifted version of another constituent component of the multiple constituent components, and evaluates an error criteria based on the target vector and the multiple constituent components to determine a gain associated with each constituent component of the multiple constituent components.

Yet another embodiment of the present invention encompasses an encoder that performs analysis-by-synthesis coding of a subframe. The encoder includes a processor and a memory that maintains multiple codebooks, wherein the processor that generates a target vector based on an input signal, generates multiple constituent components associated with a synthetic excitation signal, determines an error signal based on the target vector and the multiple constituent components, and jointly determines multiple gain parameters for the subframe based on the error signal, wherein each gain parameter of the multiple gain parameters is associated with a different codebook of the multiple codebooks and wherein the jointly determined multiple gain parameters are not determined based on a gain parameter of an earlier subframe.

Figure 3:
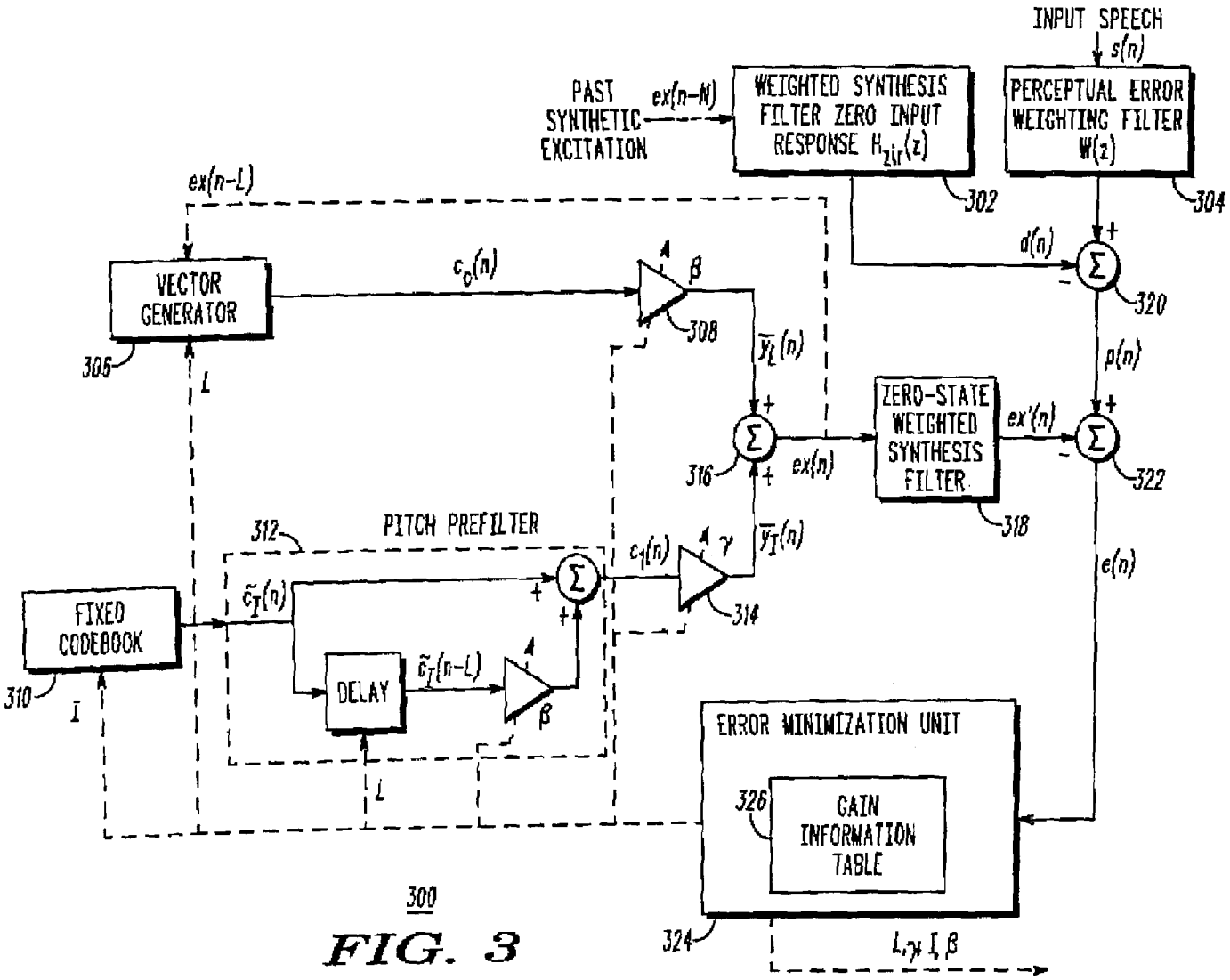
FIG. 3 is a block diagram of a Code Excited Linear Prediction (CELP) coder in accordance with an embodiment of the present invention.

The present invention may be more fully described with reference to FIGS. 3–6. FIG. 3 is a block diagram of a CELP-type speech coder 300 in accordance with an embodiment of the present invention. Coder 300 is implemented in a processor, such as one or more microprocessors, microcontrollers, digital signal processors (DSPs), combinations thereof or such other devices known to those having ordinary skill in the art, that is in communication with one or more associated memory devices, such as random access memory (RAM), dynamic random access memory (DRAM), and/or read only memory (ROM) or equivalents thereof, that store data, codebooks, and programs that may be executed by the processor.

Figure 4:
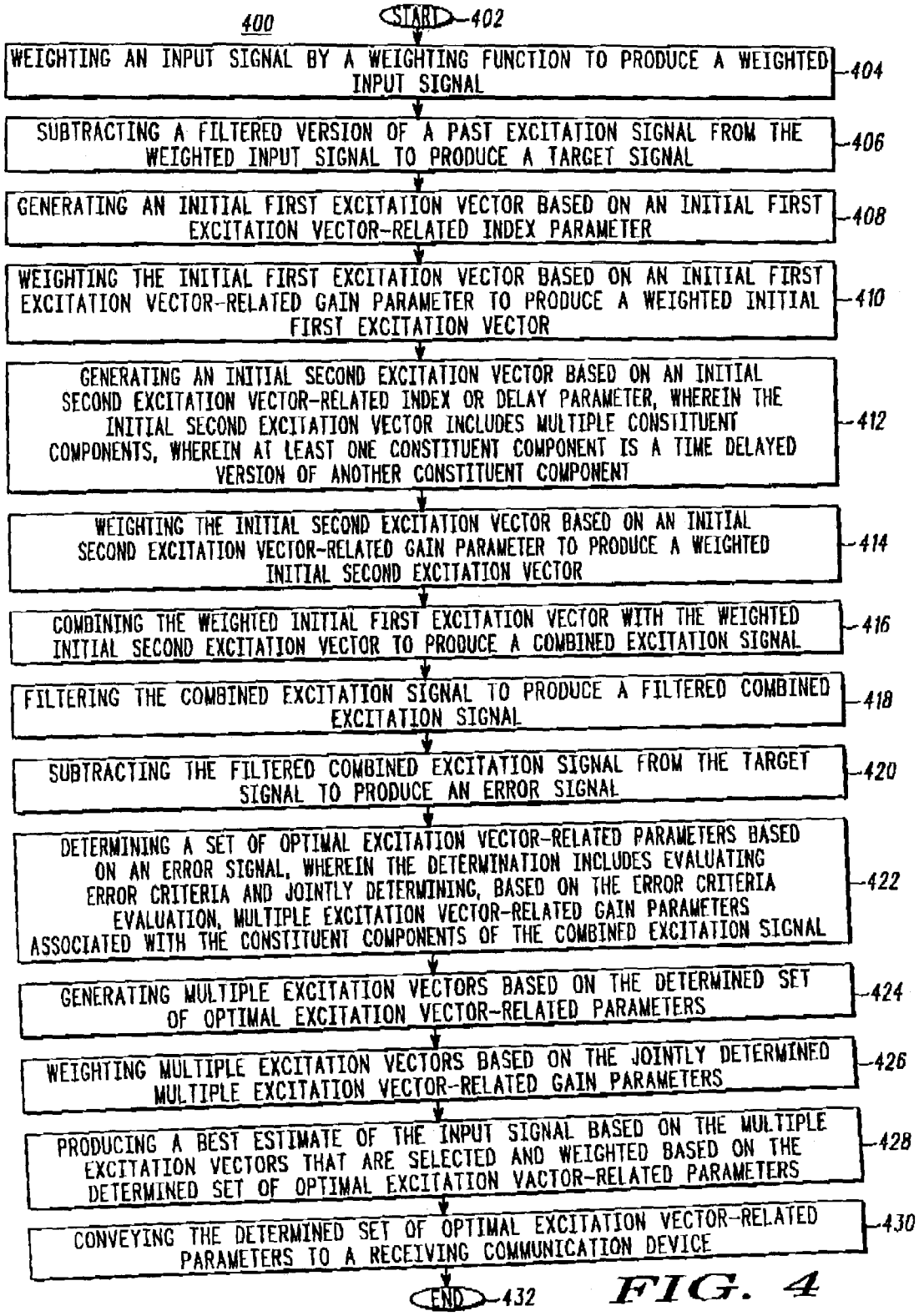
FIG. 4 is a logic flow diagram of steps executed by the CELP coder of FIG. 3 in coding a signal in accordance with an embodiment of the present invention.

FIG. 4 is a logic flow diagram 400 of the steps executed by encoder 300 in coding a signal in accordance with an embodiment of the present invention. Logic flow 400 begins (402) when an input signal s(n) is applied to a perceptual error weighting filter 304. Weighting filter 304 weights (404) the input signal by a weighting function W(z) to produce a weighted input signal s'(n). In addition, a past combined excitation signal ex(n−N), where N is a number of samples in the subframe, is made available to a weighted synthesis filter 302 along with a corresponding zero input response of $H_{zir}(z)$, to compute zero input response, d(n), of the weighted synthesis filter for the subframe. $H_{zir}$, or H, is an N×N zero-state weighted synthesis convolution matrix formed from an impulse response of a weighted synthesis filter $h_{zir}(n)$, or h(n) and corresponding to a transfer function H(z), which matrix can be represented as:

$$H = \begin{bmatrix} h(0) & 0 & \cdots & 0 \\ h(1) & h(0) & \cdots & 0 \\ \vdots & \vdots & \ddots & \vdots \\ h(N-1) & h(N-2) & \cdots & h(0) \end{bmatrix}.$$

Weighted input signal s'(n) and a filtered version of past excitation signal ex(n−N), that is, d(n), produced by weighted synthesis filter 302 are each conveyed to a first combiner 320. First combiner 320 subtracts (406) the filtered version of past excitation signal ex(n−L), that is, d(n) from the weighted input signal s'(n) to produce a target input signal p(n), where p(n)=s'(n)−d(n). Those who are of ordinary skill in the art realize that target signal p(n), as well as weighted input signal s'(n), filtered past excitation signal d(n), and all other signals described below with reference to coders 300, 500, and 600, such as combined excitation signal ex(n), filtered combined excitation signal ex'(n), and error signal e(n), may each be represented as a vector in a vector representation of the operation of the coders. First combiner 320 then conveys target input signal p(n) to a third combiner 322.

A vector generator 306 generates (408) an initial first excitation vector $c_0(n)$ based on an initial first excitation vector-related parameter L that is sourced to the vector generator by an error minimization unit 324. In one embodiment of the present invention, vector generator 306 is a virtual codebook such as an adaptive codebook (ACB) and excitation vector $c_0(n)$ is an adaptive codebook (ACB) codevector that is selected from the ACB based on an index parameter L. In another embodiment of the present invention, vector generator 306 and scaling block 308 may be replaced by an output of a pitch filter based on a delay parameter L, a past combined excitation signal ex(n−N), and β, using a transfer function of the form '$1/(1-\beta z^{-L})$.' Referring again to FIGS. 3 and 4, the initial first excitation vector $c_0(n)$ is then weighted (410) by a first weighter 308 based on an initial first gain parameter β, sourced to the weighter by error minimization unit 324, to produce a weighted initial first excitation vector $\bar{y}_L(n)$, where $\bar{y}_L(n)=\beta c_0(n)$. First weighter 308 then conveys the weighted initial first excitation vector $\bar{y}_L(n)$ to second combiner 316.

Second combiner 316 also receives a weighted initial second excitation vector $\bar{y}_1(n)$ that is produced as follows. An initial second excitation vector $\tilde{c}_1(n)$ is generated (412) by a fixed codebook 310 based on an initial second excitation vector-related index parameter I that is sourced to vector generator 310 by error minimization unit 324. Fixed codebook 310 conveys the initial second excitation vector $\tilde{c}_1(n)$ to a pitch prefilter 312 with a corresponding transfer function of '$1/(1-\beta z^{-L})$.' Pitch prefilter 312 combines the initial second excitation vector $\tilde{c}_1(n)$ with a shifted version, such as a time delayed or phase shifted version, of vector $\tilde{c}_1(n)$ that is weighted by the initial first gain parameter β, that is, $\beta\tilde{c}_1(n-L)$, to produce an excitation vector $c_1(n)$. Delay factor L and initial first gain parameter β are each sourced to pitch prefilter 312 by error minimization unit 324. Pitch prefilter 312 conveys excitation vector $c_1(n)$ to a second weighter 314 that weights (414) excitation vector $c_1(n)$ based on an initial second gain parameter γ, sourced to the weighter by error minimization unit 324, to produce the weighted filtered initial second excitation vector $\bar{y}_1(n)$ where $\bar{y}_1(n)=\gamma c_1(n)=\gamma\tilde{c}_1(n)+\beta\gamma\tilde{c}_1(n-L)$. Second weighter 314 then conveys the weighted filtered initial second excitation vector $\bar{y}_1(n)$ to second combiner 316.

Second combiner 316 combines (416) the weighted first initial excitation vector $\bar{y}_L(n)$ with the weighted filtered initial second excitation vector $\bar{y}_1(n)$ to produce the combined excitation signal ex(n), where $$ex(n)=\bar{y}_L(n)+\bar{y}_1(n)=\beta c_0(n)+\gamma\tilde{c}_1(n)+\beta\gamma\tilde{c}_1(n-L). \quad (16)$$

Second combiner 316 conveys combined excitation signal ex(n) to a zero state weighted synthesis filter 318 that filters (418) the combined excitation signal ex(n) to produce a filtered combined excitation signal ex'(n). Weighted synthesis filter 318 conveys the filtered combined excitation signal ex'(n) to third combiner 322, where the filtered combined excitation signal ex'(n) is subtracted (420) from the target signal p(n) to produce a perceptually weighted error signal e(n). Perceptually weighted error signal e(n) is then conveyed to error minimization unit 324, preferably a squared error minimization/parameter quantization block. Error minimization unit 324 uses the error signal e(n) to determine (422) a set of optimal excitation vector-related parameters L, β, I, and γ that optimize the performance of encoder 300 by minimizing the error signal e(n), wherein the determination includes jointly determining a set of excitation vector-related gain parameters, β and γ, that are associated with the constituent components of combined excitation signal ex(n), that is, $c_0(n)$, $\tilde{c}_1(n)$, and $\tilde{c}_1(n-L)$.

Based on optimized excitation vector-related parameters L and I, coder 300 generates (424) an optimal (relative to the selection criteria employed) set of first and second excitation vectors, or codevectors, $c_0(n)$ and $\tilde{c}_1(n)$ by vector generator 306 and codebook 310, respectively. Optimization of excitation vector-related gain parameters β and γ results in an optimal weighting (426), by weighters 308 and 314, of the constituent components of combined excitation signal ex(n), that is, $\tilde{c}_1(n)$, $\tilde{c}_1(n)$, and $\tilde{c}_1(n-L)$, thereby producing (428) a best estimate of the input signal s(n). Coder 300 then conveys (430) the optimal set of excitation vector-related parameters L, β, I, and γ to a receiving communication device, where a speech synthesizer uses the received excitation vector-related parameters to reconstruct the coded version of input speech signal s(n). The logic flow then ends (432). One may note that in the above discussion of FIGS. 3 and 4, a value of $L \geqq N/2$ was assumed for the example described.

Unlike the prior art coder, wherein an optimal set of excitation vector-related gain parameters β and γ for a current subframe is determined by performing a sequential optimization process, or by a joint optimization process that utilizes a gain parameter $\beta_{previous}$ associated with a previous subframe, or is a known value before the optimization process, error minimization unit 324 of encoder 300 determines an optimal set of excitation vector-related gain parameters β and γ, that is, a gain vector (β,γ) or a (β,γ) pair, by performing a joint optimization process at step (422) that is based on the processing of the current subframe. By performing a joint optimization process that is based on the processing of the current subframe, a determination of a set of excitation vector-related gain parameters β and γ is optimized since the effects that the selection of one excitation vector-related gain parameter has on the selection of the other excitation vector-related gain parameter is taken into consideration in the optimization of each parameter and the sub-optimality resulting from the use of $\beta_{previous}$ to model β at the current subframe or the use of a constant $\hat{\beta}$ is eliminated.

The step (422) of performing a joint optimization of the excitation vector-related gain parameters β and γ by error minimization unit 324 can be derived as follows. To begin, equation (1) provides a generalized difference equation that defines the synthesis function for generating the combined excitation signal ex(n) of a typical CELP coder of the prior art and is restated below:

$$ex(n)=\gamma\tilde{c}_1(n)+\beta ex(n-L),\ n=0,\ N-1. \quad (1)$$

Figure 5:
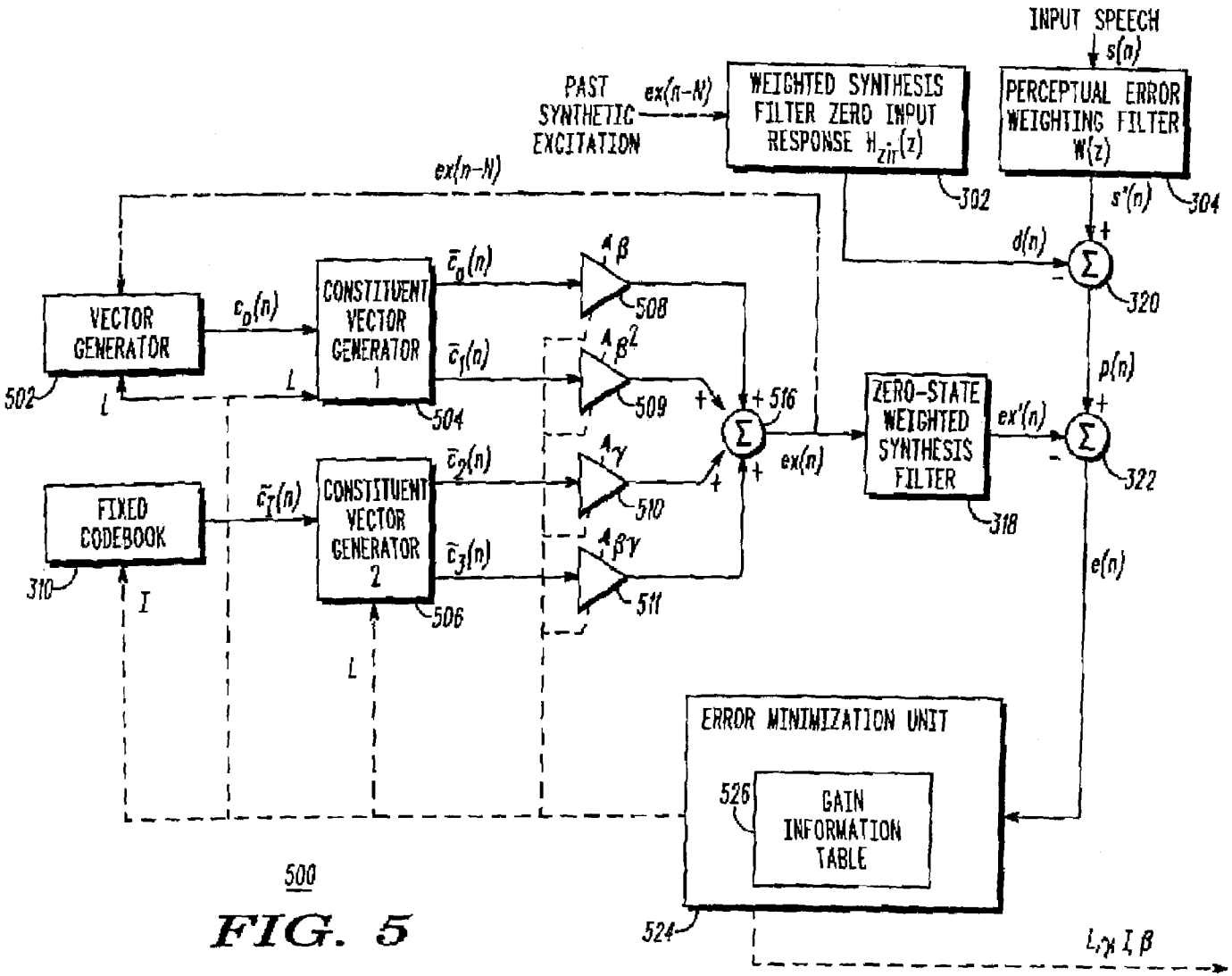
FIG. 5 is a block diagram of a Code Excited Linear Prediction (CELP) coder in accordance with another embodiment of the present invention.

Referring now to FIG. 5, consider the case when $N/2 \leqq L < N$. FIG. 5 is a block diagram of a CELP coder 500 in accordance with another embodiment of the present invention. Similar to coder 300, coder 500 is implemented in a processor, such as one or more microprocessors, microcontrollers, digital signal processors (DSPs), combinations thereof or such other devices known to those having ordinary skill in the art, that is in communication with one or more associated memory devices, such as random access memory (RAM), dynamic random access memory (DRAM), and/or read only memory (ROM) or equivalents thereof, that store data, codebooks, and programs that may be executed by the processor.

The principles employed by coder 500 to jointly optimize the excitation vector-related gain parameters β and γ can also be implemented by coder 300. Coder 500 is used merely to illustrate the principles of the present invention and is not intended to limit the invention in any way. In addition, for the purpose of illustrating the principles of the present invention, L is assumed to have integer resolution; however, those who are of ordinary skill in the art realize that L may have subsample resolution. In the event that L has subsample resolution, an interpolating filter may be used to compute the fractionally delayed samples and limits of summations may be adjusted to account for use of such an interpolating filter. When $N/2 \leqq L < N$, both β and $\beta^2$ are present in the definition of ex(n), the synthetic excitation for the subframe. For that case, ex(n) can be decomposed into a linear superposition of four constituent vectors, $\bar{c}_0(n)$ through $\bar{c}_3(n)$, which vectors can be represented by the following equations (17)–(20):

$$\bar{c}_0(n) = \begin{cases} ex(n-L), & n = 0, L-1 \\ 0, & n = L, N-1 \end{cases}, \tag{17}$$

$$\bar{c}_1(n) = \begin{cases} 0, & n = 0, L-1 \\ \bar{c}_0(n-L), & n = L, N-1 \end{cases}, \tag{18}$$

$$\bar{c}_2(n) = \tilde{c}_1(n),\ n = 0, N-1, \tag{19}$$

$$\bar{c}_3(n) = \begin{cases} 0, & n = 0, L-1 \\ \tilde{c}_1(n-L), & n = L, N-1 \end{cases}, \tag{20}$$

and which synthetic combined excitation signal ex(n) can be represented by the following equation (21):

$$ex(n)=\beta\bar{c}_0(n)+\beta^2\bar{c}_1(n)+\gamma\bar{c}_2(n)+\beta\gamma\bar{c}_3(n),\ n=0,\ N-1. \tag{21}$$

$\bar{c}_0(n)$ is the component of ex(n) for the subframe which is to be scaled by a gain β. $\bar{c}_1(n)$ is the component of ex(n) for the subframe which is to be scaled by a gain $\beta^2$. $\bar{c}_2(n)$ is the codevector contribution to ex(n) which is to be scaled by a gain γ. Finally, $\bar{c}_3(n)$ is the codevector contribution to ex(n) which is to be scaled by a gain βγ. The decomposition of equation (1) into a linear superposition of four gain-scaled constituent vectors $\bar{c}_0(n)$ through $\bar{c}_3(n)$, as shown in equation (21), explicitly decouples the constituent vectors from the gain scale factors β and γ.

That is, similar to coder 300, coder 500 applies an input signal s(n) to a perceptual error weighting filter 304. Weighting filter 304 weights (404) the input signal by a weighting function W(z) to produce a weighted input signal s'(n). In addition, a past combined excitation signal ex(n−N) is made available to a weighted synthesis filter 302 along with a corresponding zero input response of $H_{zir}(z)$, to compute zero input response, d(n), of the weighted synthesis filter for the subframe. A first combiner 320 then subtracts filtered past excitation signal d(n) from weighted input signal s'(n) to produce a target signal p(n). In addition, similar to coder 300, an initial first excitation vector $c_0(n)$ or ex(n−L) is produced by a vector generator 502, such as a virtual codebook or alternatively an LTP filter, based on an initial first excitation vector-related parameter L, and an initial second excitation vector $\tilde{c}_1(n)$ is produced by a fixed codebook (FCB) 310 based on an initial second excitation vector-related parameter I.

Unlike coder 300, a first constituent vector generator 504 included in coder 500 and coupled to vector generator 502 decomposes the initial first excitation vector $c_0(n)$, or ex(n−L), into constituent vectors $\bar{c}_0(n)$ and $\bar{c}_1(n)$. Vector $\bar{c}_0(n)$, as defined by equation (17), comprises the first L terms of vector $c_0(n)$ and vector $\bar{c}_1(n)$, as defined by equation (18), comprises the remaining terms of vector $c_O(n)$. In addition, unlike coder 300, a second constituent vector generator 506 included in coder 500 and coupled to FCB 310 generates one or more constituent components of initial second excitation vector $\tilde{c}_1(n)$ to produce vectors $\bar{c}_2(n)$ and $\bar{c}_3(n)$. Vector $\bar{c}_2(n)$, as defined by equation (19), is equivalent to vector $\tilde{c}_1(n)$ and vector $\bar{c}_3(n)$, as defined by equation (20), is comprised of zero's (0's) for the first L terms of the vector and the terms of $\tilde{c}_1(n-L)$ for the remaining N−L terms. Coder 500 then separately weights each vector $\bar{c}_0(n)$, $\bar{c}_1(n)$, $\bar{c}_2(n)$, and $\bar{c}_3(n)$ by a respective excitation vector-related gain parameter β, $\beta^2$, γ, and βγ via a respective weighter 508–511. Weighted vectors $\beta\bar{c}_0(n)$, $\beta^2\bar{c}_1(n)$, $\gamma\bar{c}_2(n)$, and $\beta\gamma\bar{c}_3(n)$ are each routed to a combiner 516, where they are added to produce combined excitation signal $ex(n)=\beta\bar{c}_0(n)+\beta^2\bar{c}_1(n)+\gamma\bar{c}_2(n)+\beta\gamma\bar{c}_3(n)$, n=0, N−1.

Similar to coder 300, combined excitation signal ex(n) is then filtered by a zero state weighted synthesis filter 318 to produce a filtered combined excitation signal ex'(n). Weighted synthesis filter 318 conveys the filtered combined excitation signal ex'(n) to a combiner 322, where the filtered combined excitation signal ex'(n) is subtracted from the target signal p(n) to produce a perceptually weighted error signal e(n). Perceptually weighted error signal e(n) is then conveyed to an error minimization unit 524, preferably a squared error minimization/parameter quantization block. Error minimization unit 524 uses the error signal e(n) to determine a set of optimal excitation vector-related parameters L, β, I, and γ that optimize the performance of encoder 500 by minimizing the error signal e(n), wherein the determination includes jointly determining an optimal set of excitation vector-related gain parameters, β and γ, thereby determining optimal gains β, $\beta^2$, γ, and βγ associated with the constituent components of combined excitation signal ex(n), that is, $\bar{c}_0(n)$, $\bar{c}_1(n)$, $\bar{c}_2(n)$, and $\bar{c}_3(n)$.

An optimal set of excitation vector-related gain parameters β and γ can be jointly determined as follows. As noted above, s'(n) corresponds to perceptually weighted speech and d(n) corresponds to a zero input response of a perceptually weighted synthesis filter for a subframe. A perceptually weighted target vector p(n) utilized by coders 300 and 500 in searches executed by the coder to define ex(n) can then be represented by the equation:

$$p(n)=s'(n)-d(n),\ n=0,\ N-1. \tag{22}$$

The synthetic excitation for the subframe, ex(n), is then applied to the perceptually weighted synthesis filter to produce a filtered synthetic excitation ex'(n). An equation for filtered synthetic excitation ex'(n) can be derived as follows. Let vectors $\bar{c}_0'(n)$ through $\bar{c}_3'(n)$ represent filtered versions of vectors $\bar{c}_0(n)$ through $\bar{c}_3(n)$, respectively. That is, vectors $\bar{c}_0(n)$ through $\bar{c}_3(n)$ are filtered by weighted synthesis filter 318 to produce vectors $\bar{c}_0(n)$ through $\bar{c}_3(n)$. Alternatively, the filtering of each of vectors $\bar{c}_0(n)$ through $\bar{c}_3(n)$ may comprise a step of convolving each vector with an impulse response of weighted synthesis filter 318. The filtered synthetic excitation vector ex'(n) can then be represented by the following equation (23):

$$ex(n)=\beta\bar{c}_0'(n)+\beta^2\bar{c}_1'(n)+\gamma\bar{c}_2'(n)+\beta\gamma\bar{c}_3'(n),\ n=0,\ N-1 \tag{23}$$

and a perceptually weighted error energy for the subframe, E, can be represented by either of the following equations (24) and (25), that is:

$$E = \sum_{n=0}^{N-1} (p(n) - ex'(n))^2 \tag{24}$$

or $$E = \sum_{n=0}^{N-1} [p(n) - \beta\bar{c}_0'(n) - \beta^2\bar{c}_1'(n) - \gamma\bar{c}_2'(n) - \beta\gamma\bar{c}_3'(n)]^2. \tag{25}$$

By expanding equation (25), it is apparent that equation (25) may be equivalently expressed in terms of (i) β and γ, (ii) the cross correlations among the filtered constituent vectors $\bar{c}_0'(n)$ through $\bar{c}_3'(n)$, that is, $(R_{cc}(i,j))$, (iii) the cross correlations between the perceptually weighted target vector p(n) and each of the filtered constituent vectors, that is, $(R_{pc}(i))$, and (iv) the energy in weighted target vector p(n) for the subframe, that is, $(R_{pp})$. The above listed correlations can be represented by the following equations:

$$R_{pp} = \sum_{n=0}^{N-1} p^2(n) \tag{26}$$

$$R_{pc}(i) = \sum_{n=0}^{N-1} p(n)\bar{c}_i'(n),\ i = 0, 3 \tag{27}$$

$$R_{cc}(i, j) = \sum_{n=0}^{N-1} \bar{c}_i'(n)\bar{c}_j'(n),\ i = 0, 3;\ j = i, 3 \tag{28}$$

$$R_{cc}(i, j) = R_{cc}(j, i),\ i = 0, 3;\ j = i + 1, 3 \tag{29}$$

Rewriting equation (25) in terms of the correlations represented by equations (26)–(29) and the gain terms β and γ then yields the following equation for the perceptually weighted error energy for the subframe E:

$$\begin{aligned} E = {} & R_{pp} - 2\beta R_{pc}(0) - 2\beta^2 R_{pc}(1) - 2\gamma R_{pc}(2) - 2\beta\gamma R_{pc}(3) + \\ & 2\beta^3 R_{cc}(0,1) + 2\beta\gamma R_{cc}(0,2) + 2\beta^2\gamma R_{cc}(0,3) + \\ & 2\beta^2\gamma R_{cc}(1,2) + 2\beta^3\gamma R_{cc}(1,3) + 2\beta\gamma^2 R_{cc}(2,3) + \\ & \beta^2 R_{cc}(0,0) + \beta^4 R_{cc}(1,1) + \gamma^2 R_{cc}(2,2) + \gamma^2\beta^2 R_{cc}(2,3) \end{aligned} \tag{30}$$

Solving for a jointly optimal set of excitation vector-related gain terms (β,γ) involves taking a first partial derivative of E with respect to β and setting the first partial derivative equal to zero (0), taking a second partial derivative of E with respect to γ and setting the second partial derivative equal to zero (0), and then solving the resulting system of two simultaneous nonlinear equations, that is, solving the following pair of simultaneous nonlinear equations:

$$\frac{\partial E}{\partial \beta} = 0,\ \frac{\partial E}{\partial \gamma} = 0 \tag{31}$$

Those who are of ordinary skill in the art realize that a solving of equation (31) does not need to be performed by either coder 300 or 500 in real time. Coders 300 and 500 may each solve equation (31) off line, as part of a procedure to train and obtain gain vectors (β,γ) that are stored in a respective gain information table 326, 526. Each gain information table 326, 526 may comprise one or more tables that store gain information, is included in, or may be referenced by, a respective error minimization unit 324, 524, and may then be used for quantizing and jointly optimizing the pair of excitation vector-related gain terms (β,γ).

Given each gain information table 326, 526 thus obtained, the task of coders 300 and 500, and in particular respective error minimization units 324, 524, is to select a gain vector, that is, a (β,γ) pair, using the respective gain gain information tables 326, 526, such that the perceptually weighted error energy for the subframe, E, as represented by equation (30), is minimized over the vectors in the gain information table which are evaluated. To assist in selecting a (β,γ) pair that yields a minimum energy for the perceptually weighted error vector, each term involving β and γ in the representation of E as expressed in equation (30) may be precomputed by each coder 300, 500 for each (β,γ) pair and stored in a respective gain information table 326, 526, wherein each gain information 326, 526 comprises a lookup table.

Once a gain vector is determined based on a gain information table 326, 526, a value of β may be obtained by multiplying, by the value '−0.5', a first term of the 14 precomputed terms (corresponding to the gain vector selected) of equation (30). Similarly, a value of γ may be obtained by multiplying, by the value '−0.5', the third of the 14 precomputed terms of equation (30). Since the correlations $R_{pp}$, $R_{pc}$, and $R_{cc}$ are explicitly decoupled from the gain terms β and γ, by the decomposition process described above, the correlations $R_{pp}$, $R_{pc}$ and $R_{cc}$ may be computed only once for each subframe. Furthermore, a computation of $R_{pp}$ may be omitted altogether because, for a given subframe, the correlation $R_{pp}$ is a constant, with the result that with or without the correlation $R_{pp}$ in equation (30) the same gain vector, that is, (β,γ) pair, would be chosen.

When the terms of the equation (30) are precomputed as described above, an evaluation of equation (30) may be efficiently implemented with 14 Multiply Accumulate (MAC) operations per gain vector being evaluated. One of ordinary skill in the art realizes that although a particular gain vector quantizer, that is, a particular format of gain information tables 326, 526, and 626, of error minimization units 324, 524 and 624 are described herein for illustrative purposes, the methodology outlined is applicable to other methods of quantizing the gain information, such as scalar quantization or vector quantization techniques, including memoryless or predictive techniques. As is well known in the art, use of scalar quantization or vector quantization techniques would involve storing gain information in the gain information tables 326 and 526 that may then be used to determine the gain vectors. One of ordinary skill in the art further realizes that although the above example illustrated the method of decomposing ex(n) into its constituent vectors for the case when $$\frac{N}{2} \le L < N,$$

the methodology outlined may easily be extended to cases where $$\frac{N}{3} \le L, < \frac{N}{2}, \frac{N}{4} \le L < \frac{N}{3},$$

and so on.

The decomposition process presented above effectively decouples the constituent vectors from the gain parameters, or scale factors, β and γ for the case when L<N, with the specific example of N/2≦L<N being given. The decomposition makes it possible to treat the constituent vectors $\bar{c}_0(n)$ through $\bar{c}_3(n)$, once they are defined by equations (17)–(20), as vectors which are independent of one another. This makes it possible to precompute, for a given subframe, the correlation terms $R_{pc}$ and $R_{cc}$ and thus efficiently evaluate equation (30). Repeating equation (21) as equation (32), again the synthetic combined excitation signal ex(n) may be represented as follows, $$ex(n)=\beta\bar{c}_0(n)+\beta^2\bar{c}_1(n)+\gamma\bar{c}_2(n)+\beta\gamma\bar{c}_3(n),\ n=0,\ N-1, \tag{32}$$

and, again, it is apparent that determining the jointly optimal gains β and γ, such that the weighted error energy E in equation (30) is minimized, involves solving a system of two simultaneous non-linear equations, that is, solving equation (31). However, as an alternative to solving the system of simultaneous equations for an optimal gain vector, that is, an optimal (β,γ) pair, a quantization of the gain vectors and a determination of an optimal pair may instead comprise retrieving each gain vector in gain information table 326, 526 and evaluating equation (30) over each of the gain vectors stored in the table and selecting a gain vector, that is, a (β,γ) pair, that results in a minimum value of E at that subframe. Alternatively, only a subset of the vectors in the gain vector quantizer, that is, gain information table 326, 526, may be preselected for evaluation so as to further limit the amount of computation related to the selection of the (β,γ) pair.

However, it may be desirable to make the solution for jointly optimal gains β and γ a linear (and therefore computationally simpler to solve) problem. This may be useful for example, if the search for the excitation codeword, or index parameter, I is conducted assuming that for each excitation codevector $\tilde{c}_i(n)$ being evaluated, for a given L, a jointly optimal set of gain scale factors is utilized. Therefore, in another, "linearized," embodiment of the present invention, a CELP coder may solve a system of simultaneous linear equations in jointly optimizing gains β and γ, for example.

Figure 6:
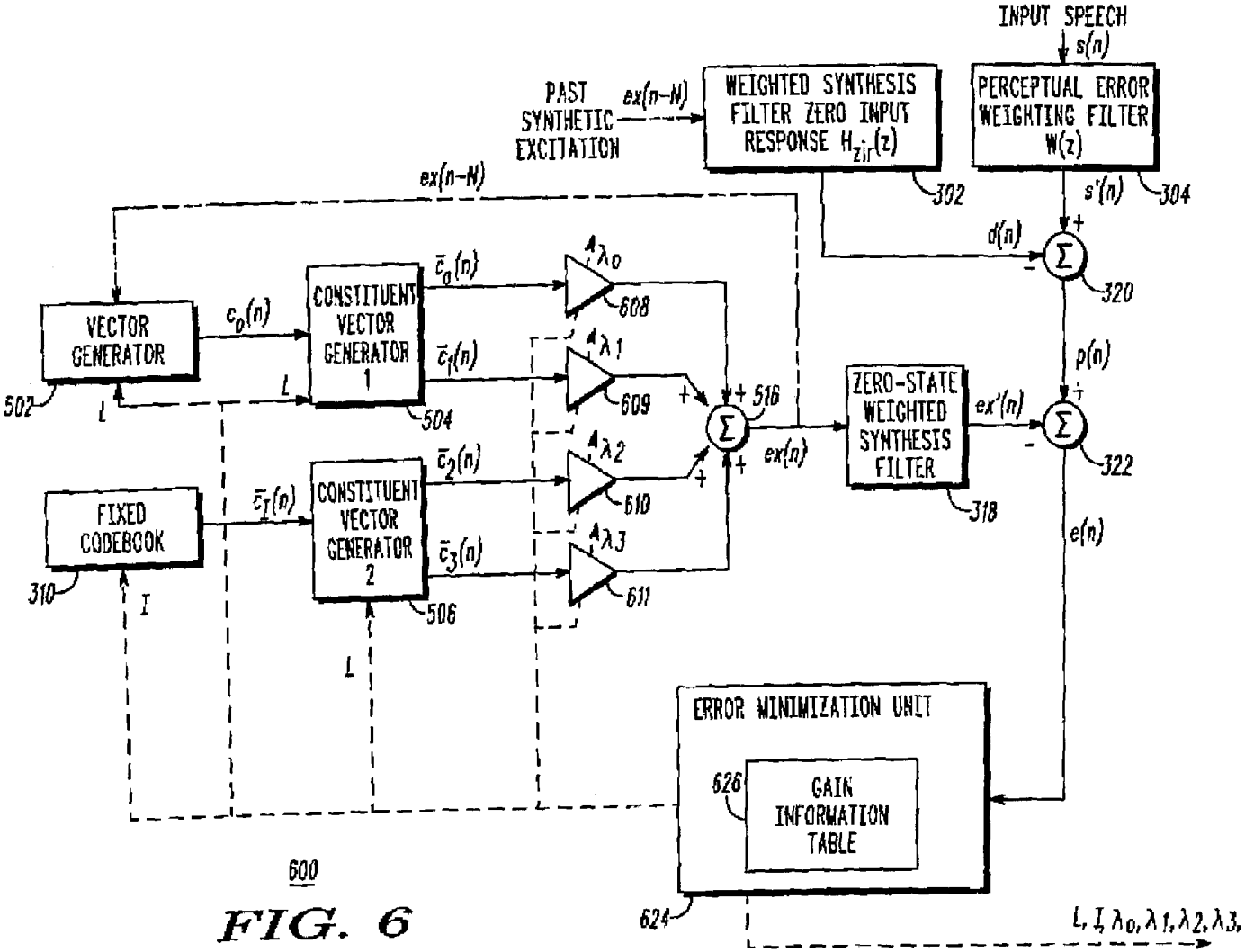
FIG. 6 is a block diagram of a Code Excited Linear Prediction (CELP) coder in accordance with another embodiment of the present invention.

FIG. 6 is a block diagram of a exemplary CELP coder 600 in accordance with the linearized embodiment of the present invention. Similar to coders 300 and 500, coder 600 is implemented in a processor that is in communication with one or more memory devices that store data, codebooks, and programs that may be executed by the processor. Coder 600 is similar to coder 500 except that, in coder 600, the scale factors, or gain parameters, associated with each of the constituent vectors $\bar{c}_0(n)$ through $\bar{c}_3(n)$ are independent. By making the scale factors independent, a linear solution may be obtained for jointly optimal excitation vector-related gain parameters. For example, equation 32 may be rewritten as follows:

$$ex(n)=\lambda_0\bar{c}_0(n)+\lambda_1\bar{c}_1(n)+\lambda_2\bar{c}_2(n)+\lambda_3\bar{c}_3(n),\ n=0,\ N-1. \tag{33}$$

where $\lambda_0,\lambda_1,\lambda_2,\lambda_3$ are the gains, or scale factors, respectively associated with constituent vectors $\bar{c}_0(n)$ through $\bar{c}_3(n)$ and applied to the constituent vectors by weighters 608–611, respectively. Those who are of ordinary skill in the art realize that the synthetic excitation function represented by equation (33) is more general formulation of the synthetic excitation function provided in equation (32). When $$\lambda_0=\beta,\lambda_1=\beta^2,\lambda_2=\gamma,\text{ and }\lambda_3=\beta\lambda, \tag{34}$$

then equation (32) and equation (33) are equivalent. Thus the formulation of ex(n) provided by equation (33), when the scale factors are chosen as shown in equation (34), is capable of implementing the CELP excitation synthesis equation (1) exactly. In this sense, coder 600 may be considered to illustration a particular, linear embodiment of coders 300 and 500. However, since the scale factors $\lambda_0,\lambda_1,\lambda_2,\lambda_3$ are allowed to be mutually independent, and the number of independent variables has been increased from two (in the case of equations for combined excitation signal ex(n) utilizing scale factors based on β and γ) to four, the constraints imposed on constructing signal ex(n) due to requiring that the scale factor multiplying $\bar{c}_1(n)$ is $\beta^2$ (a function of β) and that the scale factor for multiplying $\bar{c}_3(n)$ is βγ (a function of both β and γ) are lifted. The price for this additional flexibility is that four gain scale factors ($\lambda_0$ through $\lambda_3$) now need to be quantized, instead of two.

The subframe weighted error energy E in the linearized embodiment may be represented by the equation:

$$E=\sum_{n=0}^{N-1}[p(n)-\lambda_0\bar{c}_0'(n)-\lambda_1\bar{c}_1'(n)-\lambda_2\bar{c}_2'(n)-\lambda_3\bar{c}_3'(n)]^2 \tag{35}$$

Expanding equation (35) and expressing it in terms of the correlations results in the following equation:

$$E=R_{pp}-2\sum_{k=0}^{3}\lambda_k R_{pc}(k)+2\sum_{k=0}^{2}\sum_{l=k+1}^{3}\lambda_k\lambda_l R_{cc}(k,l)+\sum_{k=0}^{3}\lambda_k^2 R_{cc}(k,k) \tag{36}$$

In order to solve for a jointly optimal gain, or scale factor, vector $(\lambda_0,\lambda_1,\lambda_2,\lambda_3)$, equation (36) can be partially differentiated, with respect to each of the four gains, or scale factors, and each of the four resulting equations can then be set equal to zero (0):

$$\frac{\partial E}{\partial\lambda_0}=0,\ \frac{\partial E}{\partial\lambda_1}=0,\ \frac{\partial E}{\partial\lambda_2}=0,\ \frac{\partial E}{\partial\lambda_3}=0. \tag{37}$$

Evaluating the four equations in equation (37) results in a system of four simultaneous linear equations. A solution for a vector of jointly optimal gains, or scale factors, $(\lambda_0,\lambda_1,\lambda_2,\lambda_3)$ may then be obtained by solving the following equation:

$$\begin{bmatrix} R_{cc}(0,0) & R_{cc}(0,1) & R_{cc}(0,2) & R_{cc}(0,3) \\ R_{cc}(1,0) & R_{cc}(1,1) & R_{cc}(1,2) & R_{cc}(1,3) \\ R_{cc}(2,0) & R_{cc}(2,1) & R_{cc}(2,2) & R_{cc}(2,3) \\ R_{cc}(3,0) & R_{cc}(3,1) & R_{cc}(3,2) & R_{cc}(3,3) \end{bmatrix}\begin{bmatrix}\lambda_0\\ \lambda_1\\ \lambda_2\\ \lambda_3\end{bmatrix}=\begin{bmatrix}R_{pc}(0)\\ R_{pc}(1)\\ R_{pc}(2)\\ R_{pc}(3)\end{bmatrix} \tag{38}$$

The equations for the combined excitation signal ex(n) of the prior art, that is, equations (11), (12), and (13) may now be revisited and revised based on the concept of decomposing the combined excitation signal, or vector, into constituent vectors that are each independent of the gains for the case when L<N. Furthermore, the technique of making the solution for the jointly optimal set of gains a linear problem in the context of that example is also illustrated. Equations (11), (12), and (13) are now restated as the following equations (39), (40), and (41):

$$ex(n) = \beta c_o(n) + \gamma c_1(n),\ n = 0,\ N-1 \tag{39}$$

$$c_0(n) = \begin{cases} ex(n-L),\ n = 0,\ \mathrm{Min}(L, N) - 1, \\ c_0(n-L),\ n = L,\ N-1 \end{cases} \tag{40}$$

$$c_1(n) = \begin{cases} \tilde{c}_l(n),\ n = 0,\ \mathrm{Min}(\hat{L}, N) - 1, \\ \tilde{c}_l(n) + \hat{\beta} c_1(n - \hat{L}),\ n = \hat{L},\ N-1 \end{cases} \tag{41}$$

The constraint for the example being considered is that $N/2 \leqq L < N$ and $N/2 \leqq \hat{L} < N$.

Starting with equations (11)–(13), or (39)–(41), a scheme may be derived whereby error minimization units 324, 524, and 624 can determine a jointly optimal gain vector (β,γ). A virtual codebook, also known in the art as an adaptive codebook (ACB), is used to construct $c_0(n)$ in this example. The use of a virtual codebook to construct $c_0(n)$ means that a generation of $c_0(n)$ is based on ex(n), n<0 and that $c_0(n)$ is linearly combined with β in equation (39). The vector $c_1(n)$ is constructed by applying a pitch sharpening filter, which is a zero state LTP filter defined by parameters $\hat{L}$ and $\hat{\beta}$ to $\tilde{c}_1(n)$ which is the selected codevector. Applying the decomposition technique to equation (39) produces the following equation for a combined excitation signal, or vector, ex(n):

$$ex(n) = \beta \bar{c}_0(n) + \gamma \bar{c}_1(n) + \hat{\beta}\gamma \bar{c}_2(n),\ n = 0,\ N-1 \tag{42}$$

where $$\bar{c}_0(n) = \begin{cases} ex(n-L),\ n = 0,\ \mathrm{Min}(L, N) - 1, \\ \bar{c}_0(n-L),\ n = L,\ N-1 \end{cases}, \tag{43}$$

$$\bar{c}_1(n) = \tilde{c}_l(n),\ n = 1,\ N-1, \tag{44}$$

and $$\bar{c}_2(n) = \begin{cases} 0,\ n = 0,\ \mathrm{Min}(\hat{L}, N) - 1, \\ \bar{c}_1(n - \hat{L}),\ n = \hat{L},\ N-1 \end{cases}. \tag{45}$$

where vectors $\bar{c}_0(n)$, $\bar{c}_1(n)$, and $\bar{c}_2(n)$ are constituent vectors of the combined excitation vector. An energy of the weighted error, that is, E, corresponding to the combined excitation signal ex(n) represented by equation (42) may then be represented by the following equation:

$$E = \sum_{n=0}^{N-1} \left[p(n) - \beta \bar{c}_0'(n) - \gamma \bar{c}_1'(n) - \hat{\beta}\gamma \bar{c}_2'(n)\right]^2. \tag{46}$$

The energy of the weighted error, E, may also be expressed in terms of signal correlations as follows:

$$E = R_{pp} - 2\beta R_{pc}(0) - 2\gamma R_{pc}(1) - 2\hat{\beta}\gamma R_{pc}(2) + 2\beta\gamma R_{cc}(0,1) + 2\beta\hat{\beta}\gamma R_{cc}(0,2) + \hat{\beta}\gamma^2 R_{cc}(1,2) + \beta^2 R_{cc}(0,0) + \gamma^2 R_{cc}(1,1) + \hat{\beta}^2\gamma^2 R_{cc}(2,2) \tag{47}$$

The definition of $\hat{\beta}$ given by equation (14) is assumed here, that is:

$$\hat{\beta} = \mathrm{Max}(0.2,\ \mathrm{Min}(0.8, \beta)) \tag{48}$$

Note that $\hat{\beta}$ is a function of the gain parameter β used at the current subframe and not of a gain parameter of a previous subframe. Thus equation (47) has two independent variables, that is, β and γ. Solving for a jointly optimal gain vector, that is, pair of gain terms (β,γ), involves taking a first partial derivative of E, that is, of equation (47) with respect to β and setting the first partial derivative equal to zero (0), taking a second partial derivative of E with respect to γ and setting the second partial derivative equal to zero (0) and then solving a system of two simultaneous nonlinear equations which results, that is, solving the following two simultaneous nonlinear equations:

$$\frac{\partial E}{\partial \beta} = 0,\ \frac{\partial E}{\partial \gamma} = 0. \tag{48a}$$

As was previously discussed, although joint optimization of (β,γ) involves a solution of a system of simultaneous nonlinear equations, from a vantage point of implementing the quantization of the gains there is no need to solve for a jointly optimal set of gains, since the set of possible gains available to each of coders 300, 500, and 600 is limited to the set of quantized gain values which may be generated for a given subframe, by the error minimization unit being used. Thus the selection of a jointly optimal (β,γ) pair involves evaluating equation (47) over the set of gains that may be produced by the error minimization unit being used.

When it is desirable to linearize the solution for a set of jointly optimal gains, the linearization technique presented may be used. In that case, the synthetic combined excitation signal ex(n) of equation (42) may rewritten using linear scale factors as follows:

$$ex(n) = \lambda_0 \bar{c}_0(n) + \lambda_1 \bar{c}_1(n) + \lambda_2 \bar{c}_2(n),\ n = 0,\ N-1 \tag{49}$$

The corresponding subframe weighted error E may then be expressed as:

$$E = \sum_{n=0}^{N-1} \left[p(n) - \lambda_0 \bar{c}_0'(n) - \lambda_1 \bar{c}_1'(n) - \lambda_2 \bar{c}_2'(n)\right]^2 \tag{50}$$

Expanding equation (50) and expressing equation (50) in terms of the resulting correlations produces in the following expression for the subframe weighted error E:

$$E = R_{pp} - 2\sum_{k=0}^{2} \lambda_k R_{pc}(k) + 2\sum_{k=0}^{1} \sum_{l=k+1}^{2} \lambda_k \lambda_l R_{cc}(k, l) + \sum_{k=0}^{2} \lambda_k^2 R_{cc}(k, k). \tag{51}$$

In order to solve for a jointly optimal scale factor, or gain, vector $(\lambda_0, \lambda_1, \lambda_2)$, equation (51) is partially differentiated with respect to each of the three gains $\lambda_0, \lambda_1, \lambda_2$, and each of the three resulting differential equations is then set equal to zero (0), that is:

$$\frac{\partial E}{\partial \lambda_0} = 0, \frac{\partial E}{\partial \lambda_1} = 0, \frac{\partial E}{\partial \lambda_2} = 0. \tag{52}$$

A jointly optimal scale factor, or gain, vector $(\lambda_0, \lambda_1, \lambda_2)$, may then be obtained by solving the system of three simultaneous linear equations represented by the three differential equations provided in equation (52), as shown below:

$$\begin{bmatrix} R_{cc}(0,0) & R_{cc}(0,1) & R_{cc}(0,2) \\ R_{cc}(1,0) & R_{cc}(1,1) & R_{cc}(1,2) \\ R_{cc}(2,0) & R_{cc}(2,1) & R_{cc}(2,2) \end{bmatrix} \begin{bmatrix} \lambda_0 \\ \lambda_1 \\ \lambda_2 \end{bmatrix} = \begin{bmatrix} R_{pc}(0) \\ R_{pc}(1) \\ R_{pc}(2) \end{bmatrix}. \tag{53}$$

One may note that in the nonlinear and linear embodiments for determining a set of jointly optimal gains where a virtual, or adaptive, codebook is used to define $c_0(n)$ and a pitch sharpening technique is being applied to form codebook excitation vector $c_1(n)$, the gain for the pitch sharpening filter contribution participates in the minimization of weighted error E in equation (47) or equation (51). Furthermore, weighted error E is jointly optimized with the gain values being used to evaluate equation (47) or equation (51). This is in contrast to the prior art technique of implementing vector quantization of the gain information, when pitch sharpening is activated, which used a value of $\beta$ from a previous subframe to define the pitch sharpening filter coefficient $\hat{\beta}$ that is used at the current subframe. Furthermore, in the prior art the value of $\hat{\beta}$ is fixed for the subframe, and thus not allowed to change for each gain vector being evaluated. Coder 300, 500, and 600 allow for an efficient minimization of weighted subframe error energy E, by permitting the gains, including the information for defining the pitch sharpening coefficient $\hat{\beta}$, to be optimized for each vector in the gain gain information table.

What is claimed is:

1. A method for analysis-by-synthesis coding of a signal comprising steps of:

generating a target vector based on an input signal;

generating a plurality of constituent components associated with an synthetic excitation signal, wherein a first constituent component of the plurality of constituent components is based on a shifted version of a second constituent component of the plurality of constituent components;

evaluating error criteria based on the target vector and the plurality of constituent components to determine a gain parameter associated with each constituent component of the plurality of constituent components; and conveying the gain parameters to a decoder.

2. The method of claim 1, wherein the step of evaluating error criteria comprises a step of evaluating error criteria based on the target vector and the plurality of constituent components to determine a gain, wherein the gain is utilized to produce a plurality of gains, and wherein each gain of the plurality of gains is associated with each constituent component of the plurality of constituent components.

3. The method of claim 1, wherein the step of evaluating error criteria comprises steps of:

generating a system of nonlinear equations based on the plurality of constituent components; and solving the system of nonlinear equations in order to determine a gain associated with each constituent component of the plurality of constituent components.

4. The method of claim 1, wherein the step of evaluating error criteria comprises steps of:

generating a system of linear equations based on the plurality of constituent components; and solving the system of linear equations in order to determine a gain associated with each constituent component of the plurality of constituent components.

5. The method of claim 1, wherein a shift of the first constituent component is based on a periodicity of the input signal.

6. The method of claim 1, further comprising:

generating a plurality of gains associated with the first and second constituent vector based on a gain index;

generating a synthetic excitation based on the plurality of gains; and outputting a decoded speech based on the synthetic excitation.

7. The method of claim 1, wherein evaluating error criteria comprises:

generating a third constituent vector based on past synthetic excitation; and determining a gain associated with each of the first, second, and third constituent vectors such that the gain associated with the first constituent vector is a function of the gain associated with the second constituent vectors and the gain associated with the third constituent vector.

8. The method of claim 7, wherein the function to generate the gain associated with the first constituent vector is given by $\lambda 23 = \lambda 22 \min(0.9, \max(0.2, \lambda 1))$ and wherein $\lambda 3$ is the gain associated with the first constituent vector, $\lambda 22$ is the gain associated with the second constituent vector, and $\lambda 1$ is the gain associated with the third constituent vector.

9. The method of claim 1, wherein the step of evaluating error criteria comprises steps of:

evaluating an error criteria based on the target vector and the plurality of constituent components; and generating a plurality of gain parameters based on the evaluation of the error criteria.

10. The method of claim 9, further comprising a step of weighting each constituent component of the plurality of constituent components based on a gain parameter of the plurality of gain parameters.

11. The method of claim 9, wherein the step of generating a plurality of gain parameters comprises step of:

precomputing a first plurality of gain parameters to produce a plurality of precomputed gain parameters; and selecting a second plurality of gain parameters based on the precomputed plurality of gain parameters.

12. The method of claim 9, wherein the step of generating a plurality of gain parameters comprises steps of:

storing gain information; and generating a plurality of gain parameters based on the stored gain information.

13. The method of claim 9, wherein the step of evaluating the error criteria comprises a step of determining an error energy and wherein the step of generating a plurality of gain parameters based on the evaluation of the error criteria comprises a step of generating a plurality of gain parameters that minimize the error energy.

14. An apparatus for analysis-by-synthesis coding of a signal comprising:

a target vector generator means that generates a target vector based on an input signal;

a component generator that generates a plurality of constituent components associated with a synthetic excitation signal, wherein a first constituent component of the plurality of constituent components is based on a shifted version of a second constituent component of the plurality of constituent components;

an error minimization unit that evaluates error criteria based on the target vector and the plurality of constituent components to determine a gain associated with each constituent component of the plurality of constituent components; and wherein the apparatus conveys the gain parameters to a decoder.

15. The apparatus of claim 14, wherein the component generator comprises a pitch prefilter.

16. The apparatus of claim 14, wherein a shift of the first constituent component is based on a periodicity of the input signal.

17. The apparatus of claim 14, wherein the evaluation of error criteria by the error minimization unit comprises evaluating error criteria based on the target vector and the plurality of constituent components to determine a gain, wherein the gain is utilized to produce a plurality of gains, and wherein each gain of the plurality of gains is associated with each constituent component of the plurality of constituent components.

18. The apparatus of claim 14, wherein the evaluation of error criteria by the error minimization unit comprises generating a system of nonlinear equations based on the plurality of constituent components and solving the system of nonlinear equations in order to determine a gain associated with each constituent component of the plurality of constituent components.

19. The apparatus of claim 14, wherein the evaluation of error criteria by the error minimization unit comprises generating a system of linear equations based on the plurality of constituent components and solving the system of linear equations in order to determine a gain associated with each constituent component of the plurality of constituent components.

20. The apparatus of claim 14, wherein the evaluation of error criteria by the error minimization unit comprises evaluating an error criteria based on the target vector and the plurality of constituent components and generating a plurality of gain parameters based on the evaluation of the error criteria.

21. The apparatus of claim 20, further comprising a weighter that weights a constituent component of the plurality of constituent components based on a gain parameter of the plurality of gain parameters.

22. The apparatus of claim 20, wherein the generation of a plurality of gain parameters by the error minimization unit comprises precomputing a first plurality of gain parameters to produce a plurality of precomputed gain parameters and selecting a second plurality of gain parameters based on the plurality of precomputed gain parameters.

23. The apparatus of claim 20, wherein the generation of a plurality of gain parameters by the error minimization unit comprises storing gain information and generating a plurality of gain parameters based on the stored gain information.

24. The apparatus of claim 23, wherein the error minimization unit stores the gain information in a gain information table.

25. The apparatus of claim 23, wherein the of evaluation error criteria by the error minimization unit comprises determining an error energy and wherein the generation of a plurality of gain parameters by the error minimization unit comprises generating a plurality of gain parameters that minimize the error energy.

26. A speech coder that performs analysis-by-synthesis coding of a signal, the encoder comprising a processor that generates a target vector based on an input signal, generates a plurality of constituent components associated with an synthetic excitation signal, wherein one constituent component of the plurality of constituent components is based on a shifted version of another constituent component of the plurality of constituent components, and evaluates an error criteria based on the target vector and the plurality of constituent components to determine a gain associated with each constituent component of the plurality of constituent components and wherein the speech coder conveys the gain parameters to a decoder.

27. The speech coder of claim 26, wherein the speech coder evaluates error criteria by generating a Third constituent vector based on past synthetic excitation and determining a gain associated with each of the first, second, and third constituent vectors such that the gain associated with the first constituent vector is a function of the gain associated with the second constituent vectors and the gain associated with the third constituent vector.

28. The speech coder of claim 27, wherein the function to generate the gain associated with the first constituent vector is given by $\lambda 3 = \lambda 2 \min(0.9, \max(0.2, \lambda 1))$ and wherein $\lambda 3$ is the gain associated with the first constituent vector, $\lambda 2$ is the gain associated with the second constituent vector, end $\lambda 1$ is the gain associated with the third constituent vector.

* * * * *